US005703326A

United States Patent [19]

Yamada et al.

[11] Patent Number: 5,703,326

[45] Date of Patent: Dec. 30, 1997

[54] CONNECTION OF ELECTRICAL LEADS IN ELECTROLUMINESCENT LIGHT BY MEANS OF PARALLEL CONNECTION TO A PLURALITY OF CONDUCTORS

[75] Inventors: Hiromu Yamada; Seiji Okabe, both of Shiga, Japan

[73] Assignee: NEC Corporation, Tokyo, Japan

[21] Appl. No.: 665,698

[22] Filed: Jun. 24, 1996

[30] Foreign Application Priority Data

Jun. 23, 1995 [JP] Japan ..... 7-157623

[51] Int. Cl.[6] ..... H01J 5/46

[52] U.S. Cl. ..... 174/50.52; 174/94 R

[58] Field of Search ..... 174/50.52, 50.51, 174/50.53, 94 R; 439/885, 886, 887; 228/4.5, 179.1; 29/843, 860; 219/56.1, 56.21, 56.22

[56] References Cited

U.S. PATENT DOCUMENTS

| | | | |
|---|---|---|---|
| 1,171,591 | 2/1916 | Chubb | 174/94 R X |
| 2,644,100 | 6/1953 | Braunsdorff . | |
| 3,673,313 | 6/1972 | Pickett et al. | 174/94 R X |
| 4,015,165 | 3/1977 | Hardies | 174/50.52 X |
| 4,681,382 | 7/1987 | Lockard | 29/860 X |
| 4,702,003 | 10/1987 | Theisen et al. | 29/843 X |
| 4,926,548 | 5/1990 | Hopkins et al. | 29/860 |
| 5,060,843 | 10/1991 | Yasuzato et al. | 228/179.1 |
| 5,081,764 | 1/1992 | Utunomiya et al. | 29/843 |
| 5,095,178 | 3/1992 | Hollingsworth | 174/94 R |
| 5,317,804 | 6/1994 | Kasper | 29/860 |

FOREIGN PATENT DOCUMENTS 61-114799 7/1986 Japan .

*Primary Examiner*—Kristine L. Kincaid
*Assistant Examiner*—Dean A. Reichard
*Attorney, Agent, or Firm*—Sughrue, Mion, Zinn, Macpeak & Seas, PLLC

[57] ABSTRACT

The present invention provides an electrical connection of electrode leads externally extending from an electroluminescent light to conductors of a flexible lead one to one, characterized in that each of the electrode leads is bonded to a plurality of the conductors of the flexible lead in electrical communication. For instance, each of the electrode leads straddles two conductors in parallel, and is soldered to the two conductors. For another instance, each of the electrode leads obliquely extends from the electroluminescent light to cross over a plurality of the conductors. The invention makes it possible to make electrical contact between electrode leads and conductors of a flexible lead, even when a pitch between adjacent electrode leads is not consistent with a pitch between adjacent conductors. Thus, it is no longer necessary to prepare a specific flexible lead suitable only to a certain electroluminescent light. It is now possible to use commercially available flexible leads, which lowers fabrication cost of an electroluminescent light.

18 Claims, 4 Drawing Sheets

CONNECTION OF ELECTRICAL LEADS IN ELECTROLUMINESCENT LIGHT BY MEANS OF PARALLEL CONNECTION TO A PLURALITY OF CONDUCTORS

BACKGROUND OF THE INVENTION

1. Field of the Invention

The invention relates to an electroluminescent (hereinafter, referred to simply as "EL") light to be used for a back light of a liquid crystal display (LCD), and more particularly to an improvement in electrical connection of electrode leads in an EL light to external leads such as a flexible lead.

2. Description of the Related Art

In general, a conventional EL light has a structure in which an electroluminescence device composed of a multi-layered structure including a back electrode, a reflecting insulating layer, a light-emitting layer and a transparent electrode vertically sandwiched between a pair of outer films in hermetically sealed fashion. Specifically, as illustrated in FIG. 1, a conventional organic type electroluminescent (EL) light 44 has an almost rectangular and planar electroluminescence device 35 vertically sandwiched between a pair of flexible outer films 38 and 39 made of fluorine family resin and having moisture proof characteristics via a pair of moisture adsorption films 36 and 37 made of polyamide in hermetically sealed fashion with a pair of electrode leads 40 and 42 made of phosphor bronze extending from the electroluminescence device 35 through the outer films 38 and 39. The electroluminescence device 35 has a multi-layered structure including a back electrode 30 made of an aluminum foil, a reflecting insulating layer 31 having organic binders including barium titanate dispersed therein, a light-emitting layer 32 having organic binders including fluorescent material such as zinc sulphide activated with copper, a transparent electrode 33 made of indium-tin oxide (ITO), and a transparent plastic sheet 34 acting as a substrate for the transparent electrode 33, each deposited one on the other in this order.

The electrode lead 40 is temporarily attached to an end of the back electrode 30 with an adhesive tape 41, and then sandwiched between the moisture adsorption film 37 and the back electrode 30 by covering the electroluminescence device 35 with the outer films 38 and 39. The electrode lead 40 is thus fixed by a compression force exerted by the outer films 38 and 39. In a similar way, the electrode lead 42 is temporarily attached to an end of the transparent electrode 33 with an adhesive tape 43, and then sandwiched between the light-emitting layer 32 and the transparent electrode 33 by covering the electroluminescence device 35 with the outer films 38 and 39. The electrode lead 42 is thus fixed by a compression force exerted by the outer films 38 and 39.

An example of a connection between electrode leads of an electroluminescent light and an external cable is found in Japanese Unexamined Utility Model No. 61-114799, which is illustrated in FIG. 2. The back electrode 30 and the transparent electrode 33 are physically and hence electrically connected to the electrode leads 40 and 42, respectively. As illustrated in FIG. 2, the electrode leads 40 and 42 are connected at their ends to conductors 45 and 46 of a flexible lead 47, respectively, with connections 48 and 49 between the electrode leads 40, 42 and the conductors 45, 46 being thermally compressed to be bonded with the outer films 38 and 39.

In conventional ways, an electroluminescent light having electrode leads connected to the transparent and back electrodes is often connected to an externally located power supply through a substrate or connector to which an end of the electrode leads is directly soldered. However, if directly soldered, it would be quite difficult to remove an electroluminescent light from an external power supply. In addition, soldering an end of the electrode leads to a substrate or connector requires a few more fabrication steps, which raises fabrication cost. Furthermore, the soldering poses an additional problem that a soldered portion of the electrode leads cannot avoid having to have an increased width.

In conventional ways for connecting electrode leads of an electroluminescent light to a flexible lead, it is necessary to prepare a flexible lead including conductors spaced away from one another at the same pitch as a pitch at which electrode leads of the electroluminescent light are spaced. Thus, it is necessary to prepare molds for fabricating flexible leads having different conductor pitches, which inevitably causes fabrication cost to be increased. For instance, a mold for molding a specific flexible lead costs about ten thousand dollars. Since a variety of EL lights are generally made only in a small number, it is not economical to prepare molds for individual flexible leads.

SUMMARY OF THE INVENTION

In view of the above mentioned problems of the prior art, it is an object of the present invention to provide an improved connection between electrode leads in an EL light and conductors of a flexible lead in order to avoid preparing flexible leads having various conductor pitches and make it possible to use commercially available, cheap flexible leads for lowering fabrication cost.

The present invention provides an electrical connection of electrode leads externally extending from an electroluminescent light to conductors of a flexible lead, characterized in that each of the electrode leads is bonded to a plurality of the conductors of the flexible lead in electrical communication.

For instance, each of the electrode leads may straddle two conductors in parallel, and is soldered to the two conductors. For another instance, each of the electrode leads may obliquely extend from the electroluminescent light to cross over a plurality of the conductors of the flexible lead. As an alternative, each of the electrode leads may include a first portion perpendicularly extending through a peripheral edge of the electroluminescent light and a second portion extending perpendicularly to the first portion, the second portion being bonded to a plurality of the conductors of the flexible lead. Each of the electrode leads may be designed to have a larger width portion at which each of the electrode leads is bonded to a plurality of the conductors of the flexible lead. The larger width portion may be formed between opposite ends of the electrode leads or at a distal end of each of the electrode leads. In addition, the electrode leads may be designed to have a length different from one another.

The present invention further provides an electrical connection of electrode leads externally extending from an electroluminescent light to conductors of a flexible lead, characterized in that each of the electrode leads is bonded to a plurality of the conductors of the flexible lead in electrical communication, and that bonding sites between the electrode leads and the conductors are covered with an insulator.

It is preferable to cover a peripheral edge of the electroluminescent light with the insulator. The insulator may be formed in various ways. For instance, a heat sealing tape may be used as the insulator. For another instance, the insulator may be composed of a film made of resin. As an alternative, the insulator may be formed by applying resin paste to the bondings or printing resin paste over the bondings.

In accordance with the above mentioned invention, a connection between an electroluminescent light and conductors in a flexible lead can be strengthened by fixedly connecting an electrode lead of an electroluminescent light to a plurality of conductors of a flexible lead. In addition, even if a pitch between adjacent electrode leads is not equal to a pitch between adjacent conductors of a flexible lead, the present invention makes it possible to electrically connect the electrode leads to the conductors. Hence, it is no longer necessary to prepare a specific flexible lead suitable only to a certain electroluminescent light. If a specific flexible lead is necessary, it takes about ten thousand dollars to fabricate a mold for fabricating such a specific flexible lead. However, the present invention makes it possible to use commercially available, cheap flexible leads, which makes it no longer necessary to prepare a specific flexible lead and lowers fabrication cost of an electroluminescent light.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1:
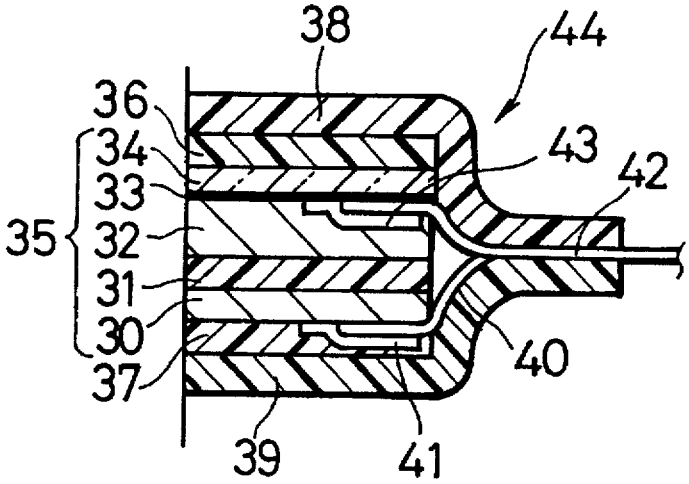
FIG. 1 PRIOR ART
FIG. 1 is a partial cross-sectional view of a conventional electroluminescent light.
Figure 2:
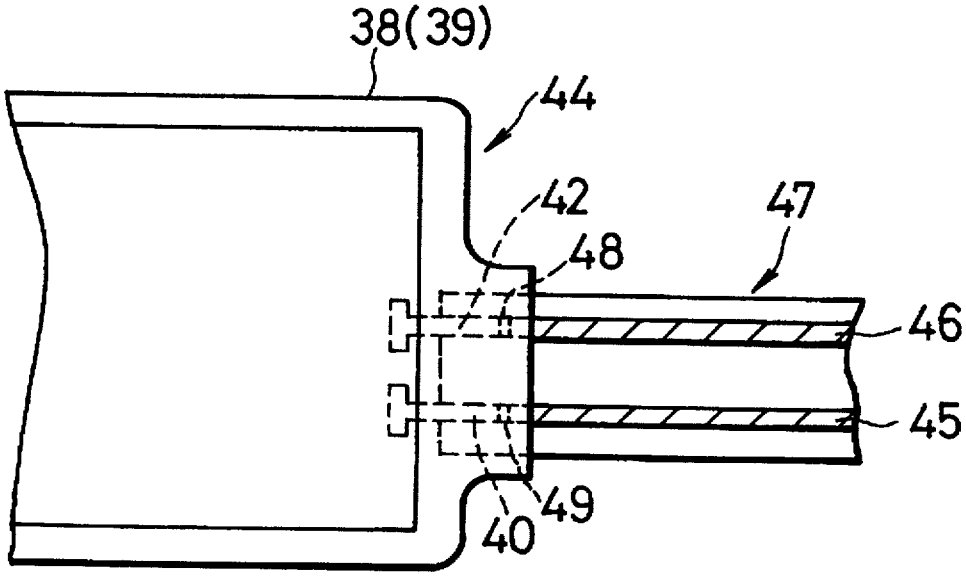
FIG. 2 PRIOR ART
FIG. 2 is a plan view illustrating a conventional connection of electrode leads of an electroluminescent light and conductors of a flexible lead.
Figure 3:
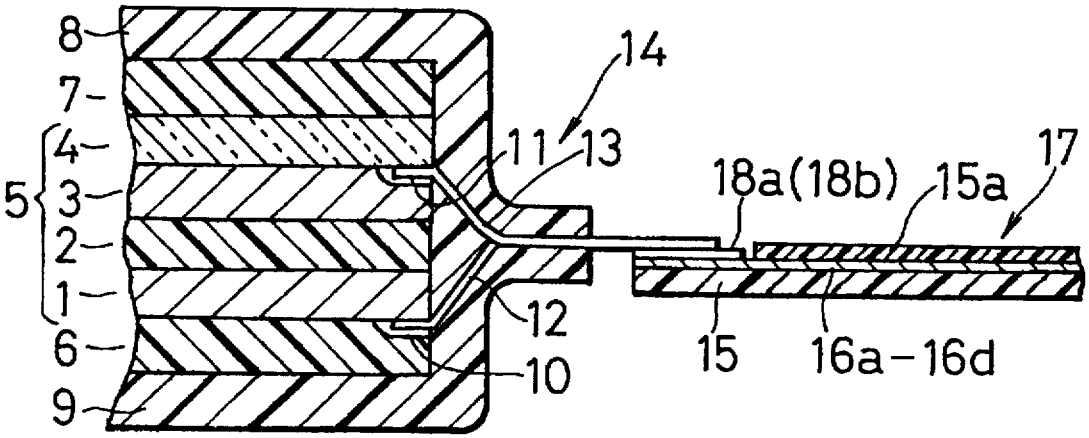
FIG. 3 is a partial cross-sectional view of the first embodiment of the present invention.
Figure 4:
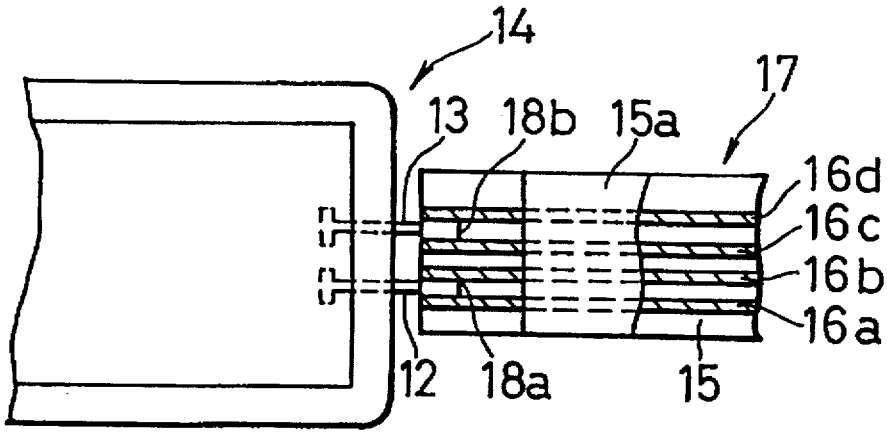
FIG. 4 is a partial plan view of the first embodiment illustrated in FIG. 3.

FIGS. 3 and 4 illustrate the first embodiment of the present invention. A electroluminescent (EL) light 14 has an almost rectangular and planar electroluminescence device 5 vertically sandwiched between a pair of flexible outer films 8 and 9 via a pair of moisture adsorption films 6 and 7 made of polyamide in hermetically sealed fashion with a pair of electrode leads 12 and 13 made of phosphor bronze and plated with tin extending from the electroluminescence device 5 through the outer films 8 and 9. The outer films 8 and 9 are made of fluorine family resin and have moisture proof characteristics. The electroluminescence device 5 has a multi-layered structure including a back electrode 1 made of an aluminum foil, a reflecting insulating layer 2 having organic binders including barium titanate dispersed therein, a light-emitting layer 3 having organic binders including fluorescent material such as zinc sulphide activated with copper, and a transparent electrode 4 made of ITO, each of which is deposited one on the other in this order.

The electrode lead 12 is temporarily attached to an end of the back electrode 1 with an adhesive tape 10, and then sandwiched between the moisture adsorption film 6 and the back electrode 1 by covering the electroluminescence device 5 with the outer films 8 and 9. The electrode lead 12 is thus fixed by a compression force exerted by the outer films 8 and 9. In a similar way, the electrode lead 13 is temporarily attached to an end of the transparent electrode 4 with an adhesive tape 11, and then sandwiched between the light-emitting layer 3 and the transparent electrode 4 by covering the electroluminescence device 5 with the outer films 8 and 9. The electrode lead 13 is thus fixed by a compression force exerted by the outer films 8 and 9.

As illustrated in FIG. 4, the electrode leads 12 and 13 of the EL light 14 are connected at their free ends to a flexible lead 17 made of a plastic substrate such as a polyethylene terephthalate (PET) film 15 on which a plurality of conductors **16*a*, 16*b*, 16*c* and 16*d* are formed by printing electrically conductive ink on the film 15. Almost all portions of the conductors 16*a* to 16*d* are covered with an insulator 15*a* so that the insulator 15*a* does not cover the electrode leads 12 and 13 extending from the EL light 14**.

The electrode 12 is arranged to straddle the conductors **16*a* and 16*b* in parallel, and is soldered to the conductors 16*a* and 16*b* with a solder fillet 18*a*. In a similar way, the electrode 13 is arranged to straddle the conductors 16*c* and 16*d* in parallel, and is soldered to the conductors 16*c* and 16*d* with a solder fillet 18*b*. In order to ensure the above mentioned connection between the electrode leads 12, 13 and the conductors 16*a* to 16*d***, it is preferable to use wide electrode leads or a flexible lead having a small pitch between adjacent conductors.

The electrode leads 12 and 13 have dimensions as follows.

Width: 1.0 mm

Thickness: 50–100 μm

Length: Allowed to select any length. However, it is preferable for the electrode leads 12 and 13 to have length equal to or greater than 4 mm, because most of commercially available flexible leads include the conductors **16*a* to 16*d* having portions exposed out of the insulator 15*a*** which are 4, 5 or 6 mm long.

Pitch between the electrode leads: 3, 5 or 7 mm

The flexible lead 17 has dimensions as follows.

Width of the conductors: <1.0 mm

Pitch between the conductors: <1.0 mm

Width of the flexible lead: >Pitch between the electrode leads

In accordance with the above mentioned first embodiment, each of the electrode leads 12 and 13 is bonded to a plurality of the conductors, resulting in that bonding strength between the electrode leads 12, 13 and the conductors **16*a* to 16*d*** is increased with the result of higher reliability, and that it becomes possible to use commercially available flexible leads having different conductor pitches with the result of lower cost.

Figure 5:
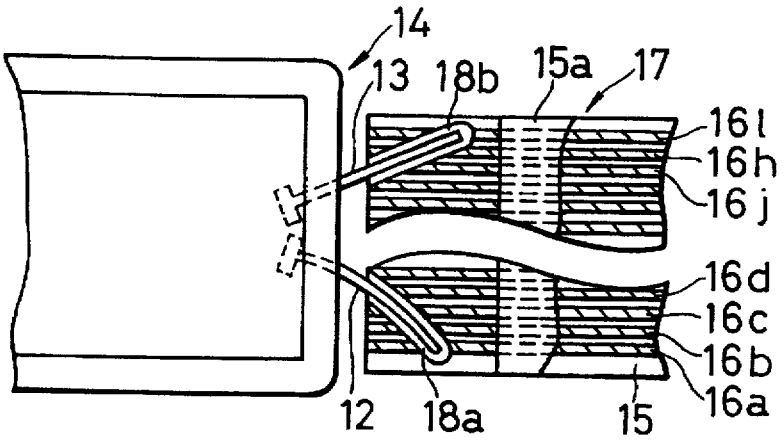
FIG. 5 is a partial plan view of the second embodiment of the present invention.

Turning to FIG. 5, hereinbelow is described the second embodiment of the present invention. In the second embodiment, the electrode leads 12 and 13 obliquely extend from the EL light 14, and cross a plurality of conductors of the flexible lead 17. Specifically, the electrode lead 12 crosses the three conductors 16*a* to 16*c*, and is fixedly soldered to the three conductors 16*a* to 16*c* with the solder fillet 18*a*, whereas the electrode lead 13 crosses the three conductors 16*j* to 16*l*, and is fixedly soldered to the three conductors 16*j* to 16*l* with the solder fillet 18*b*.

In accordance with the second embodiment, it is possible to bond each of the electrode leads to three conductors or more, resulting in enhanced reliability. In addition, it is also possible to use flexible leads having any conductor pitch. Thus, the second embodiment makes it possible to increase a number of conductors to which an electrode lead is to be bonded and an area in which an electrode lead is bonded to conductors in comparison with the first embodiment in which the electrode leads are disposed in parallel with the conductors of the flexible lead.

Figure 6:
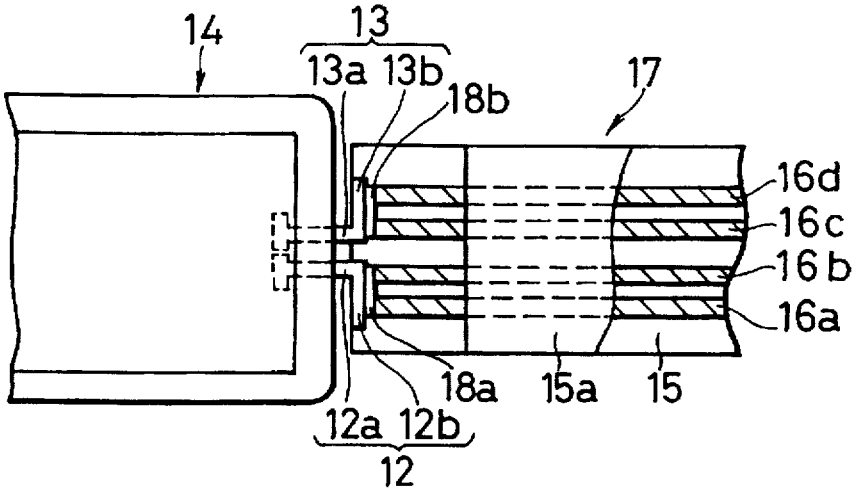
FIG. 6 is a partial plan view of the third embodiment of the present invention.

FIG. 6 illustrates the third embodiment of the present invention. In the third embodiment, each of the electrode leads 12 and 13 is comprised of first portions 12*a* and 13*a* perpendicularly extending through a peripheral edge 14*a* of the EL light 14, and second portions 12*b* and 13*b* extending perpendicularly to the first portions 12*a* and 13*a*, namely, in parallel with the peripheral edge 14*a* of the EL light 14. The second portion 12*b* of the electrode lead 12 is fixedly bonded to the conductors 16*a* and 16*b* with the solder fillet 18*a*, whereas the second portion 13*b* of the electrode lead 13 is fixedly bonded to the conductors 16*c* and 16*d* with the solder fillet 18*b*.

In accordance with the third embodiment, it is possible to bond each of the electrode leads to a desired number of conductors of a flexible lead, resulting in enhanced reliability. In addition, it is also possible to use flexible leads having any conductor pitch, similarly to the second embodiment.

Figure 7:
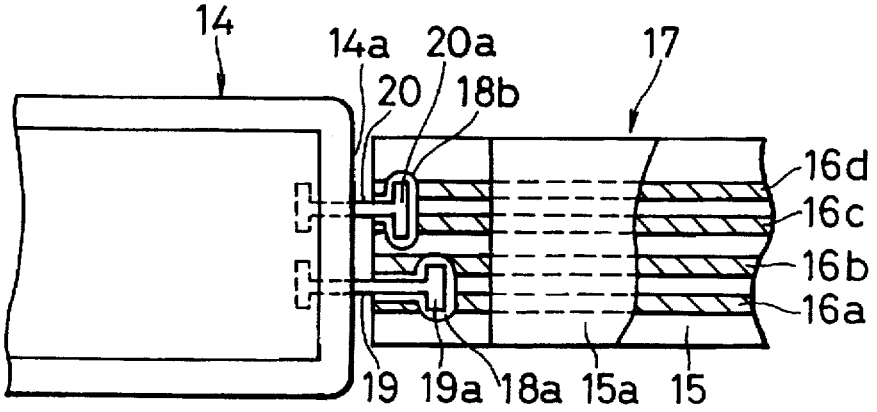
FIG. 7 is a partial plan view of the fourth embodiment of the present invention.

Turning to FIG. 7, hereinbelow is described the fourth embodiment. As illustrated, the EL light 14 has two electrode leads 19 and 20 having different lengths. Each of the electrode leads 19 and 20 is formed at distal ends thereof with wider width portions 19*a* and 20*a*, respectively. The wider width portion 19*a* of the electrode lead 19 is disposed straddling the conductors 16*a* and 16*b* of the flexible lead 17, and is fixedly soldered to the conductors 16*a* and 16*b* with the solder fillet 18*a*. The wider width portion 20*a* of the electrode lead 20 is disposed straddling the conductors 16*c* and 16*d* of the flexible lead 17, and is fixedly soldered to the conductors 16*c* and 16*d* with the solder fillet 18*b*.

In accordance with the fourth embodiment, it is possible to bond each of the electrode leads 19 and 20 to a plurality of conductors in wider bonding area than the earlier mentioned first to third embodiments.

It should be noted that the electrode leads 19 and 20 may be designed to have the same length, and that the electrode leads 19 and 20 may be formed with the wider width portions 19*a* and 20*a* at any position between the peripheral edge 14*a* of the EL light 14 and the distal ends of the leads 19 and 20.

Figure 8A:
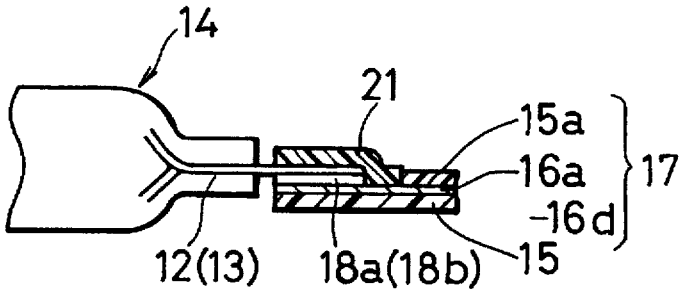
FIG. 8A is a partial cross-sectional view of the fifth embodiment of the present invention.
Figure 8B:
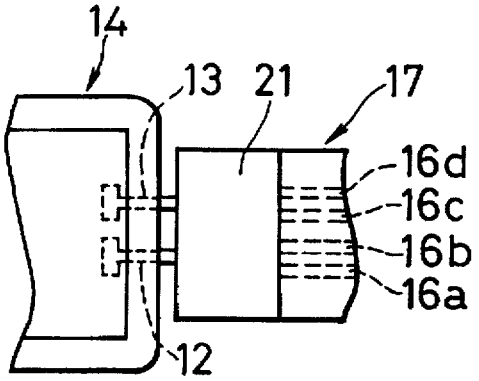
FIG. 8B is a partial plan view of the fifth embodiment illustrated in FIG. 8A.

The fifth embodiment of the present invention is illustrated in FIGS. 8A and 8B. The electrode leads 12 and 13 of the EL light 14 is fixedly bonded to a plurality of the conductors of the flexible lead 17 with the solder fillets 18*a* and 18*b* in accordance with one of the above mentioned first to fourth embodiments. Bonding sites at which the electrode leads 12 and 13 are bonded to the conductors are covered with an insulator such as a heat sealing tape 21. The heat sealing tape 21 ensures insulation of the bonding sites, and also increases the bonding strength of the electrode leads 12 and 13 to the flexible lead 17.

As an alternative to the heat sealing tape 21, a film made of resin may be used as an insulator. Alternatively, the insulator may be formed by applying resin paste to the bonding sites, or by printing resin paste over the bonding sites.

Figure 9:
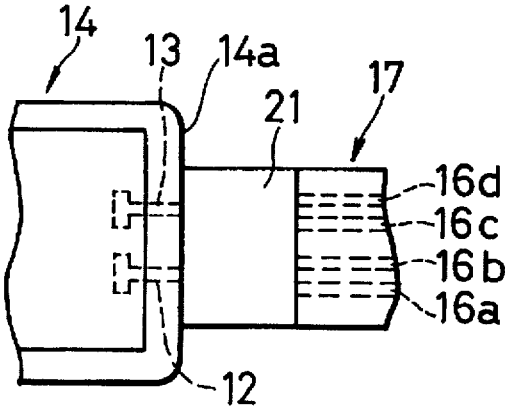
FIG. 9 is a partial plan view of a variant of the fifth embodiment of the present invention.

Though the insulator 21 covers only the flexible tape 17 in the fifth embodiment illustrated in FIGS. 8A and 8B, it should be noted that the insulator may be designed to extend to the peripheral edge 14*a* of the EL light 14, as illustrated in FIG. 9.

It would be obvious to those skilled in the art to be able to apply the present invention to a thin EL light having no moisture adsorption films and outer films.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An electrical connection of electrode leads externally extending from an electroluminescent light to conductors of a flat flexible lead, said conductors making no contact with each other, characterized in that each of said electrode leads is bonded to a plurality of said conductors of said flat flexible lead in electrical communication.

2. The electrical connection as set forth in claim 1, wherein each of said electrode leads straddles at least two of said conductors in parallel, and is bonded to said at least two conductors by means of soldering.

3. The electrical connection as set forth in claim 1, wherein each of said electrode leads obliquely extends from said electroluminescent light to cross over said plurality of said conductors of said flexible lead.

4. The electrical connection as set forth in claim 1, wherein each of said electrode leads comprises a first portion perpendicularly extending through a peripheral edge of said electroluminescent light and a second portion extending perpendicularly to said first portion, said second portion being bonded to said plurality of said conductors of said flexible lead.

5. The electrical connection as set forth in claim 1, wherein each of said electrode leads has a larger width portion at which each of said electrode leads is bonded to said plurality of said conductors.

6. The electrical connection as set forth in claim 5, wherein said larger width portion is formed at a distal end of each of said electrode leads.

7. The electrical connection as set forth in claim 5, wherein each of said electrode leads have a length different from a length of each other lead.

8. The electrical connection as set forth in claim 6, wherein each of said electrode leads have a length different from a length of each other lead.

9. An electrical connection of electrode leads extending from an electroluminescent light to conductors of a flat flexible lead, said conductors making no contact with each other, characterized in that each of said electrode leads is bonded to a plurality of said conductors of said flat flexible lead in electrical communication, and that bonding sites between said electrode leads and said conductors are covered with an insulator.

10. The electrical connection as set forth in claim 9, wherein said insulator is a heat sealing tape.

11. The electrical connection as set forth in claim 9, wherein said insulator is a film made of resin.

12. The electrical connection as set forth in claim 9, wherein said insulator is formed by applying resin paste to said bonding sites.

13. The electrical connection as set forth in claim 9, wherein said insulator is formed by printing resin paste over said bonding sites.

14. An electrical connection of electrode leads externally extending from an electroluminescent light to conductors of a flexible lead, characterized in that each of said electrode leads is bonded to a plurality of said conductors of said flexible lead in electrical communication, and that bonding sites between said electrode leads and said conductors are covered with an insulator, wherein a peripheral edge of said electroluminescent light is also covered with said insulator.

15. The electrical connection as set forth in claim 14, wherein said insulator is a heat sealing tape.

16. The electrical connection as set forth in claim 14, wherein said insulator is a film made of resin.

17. The electrical connection as set forth in claim 14, wherein said insulator is formed by applying resin paste to said bonding sites.

18. The electrical connection as set forth in claim 14, wherein said insulator is formed by printing resin paste over said bonding sites.

* * * * *